United States Patent [19]

Rowley

[11] Patent Number: 4,628,781

[45] Date of Patent: Dec. 16, 1986

[54] LUMBER MILL SYSTEM

[76] Inventor: Daniel S. Rowley, 4660 NW. Kiwanda Dr., Portland, Oreg. 97229

[21] Appl. No.: 627,451

[22] Filed: Jul. 3, 1984

[51] Int. Cl.[4] ..... B27B 7/02

[52] U.S. Cl. ..... 83/371; 83/435; 83/435.2; 83/13; 198/468.2; 414/745

[58] Field of Search ..... 83/364, 424, 371, 425.2, 83/928, 425.3, 732, 425.4, 435, 435.2, 71, 72, 522, 417; 414/745–748; 198/486, 434, 468.2

[56] References Cited

U.S. PATENT DOCUMENTS

| | | | |
|---|---|---|---|
| 2,829,683 | 4/1958 | Skinner | 83/435.2 |
| 2,964,074 | 12/1960 | Brown | 83/435.2 |
| 3,858,713 | 1/1975 | Allen | 198/200 |
| 4,173,277 | 11/1979 | Zimmerman | 414/745 |
| 4,231,464 | 11/1980 | Neilson | 198/456 |
| 4,262,572 | 4/1981 | Flodin | 83/471.2 |
| 4,316,491 | 2/1982 | Kearnes et al. | 83/72 |
| 4,358,010 | 11/1982 | Besch | 198/838 |
| 4,407,629 | 10/1983 | Willis | 414/745 |
| 4,419,914 | 12/1983 | Evans | 83/435.2 |
| 4,431,362 | 2/1984 | Wech et al. | 414/745 |
| 4,485,861 | 12/1984 | Nilsson | 83/364 |

OTHER PUBLICATIONS

Log Boss Systems/Applied Theory Brochure, "Fast and Accurate! Recovery/Throughput/Quality", undated.

*Primary Examiner*—James M. Meister
*Assistant Examiner*—John L. Knoble
*Attorney, Agent, or Firm*—Klarquist, Sparkman, Campbell, Leigh & Whinston

[57] ABSTRACT

A lumber mill system includes an endless lower spike chain conveyor, log loading charger for loading logs one at a time onto such charger such that the geometrical center is laterally offset from the longitudinal centerline of the conveyor and microprocessor for determining the optimum amount of lateral offset, if any, to maximize lumber recovery from the log. The log loading charger includes a frame pivotable about a pivot axis, axial carriage supported by the frame for horizontal movement in the same direction as the lower conveyor, and tandem radial carriages supported by the axial carriage for movement toward and away from the pivot axis. The radial carriages support clamp arms for gripping the log. The charger operates to grip a log adjacent the lower conveyor, swing the log above the lower conveyor to the predetermined laterally offset position, and lower the log onto the lower conveyor while simultaneously moving the log downstream with the conveyor. An endless overhead spike chain engages an upper surface of the log to support it on the lower conveyor and minimize other than downstream movement of the log.

22 Claims, 18 Drawing Figures

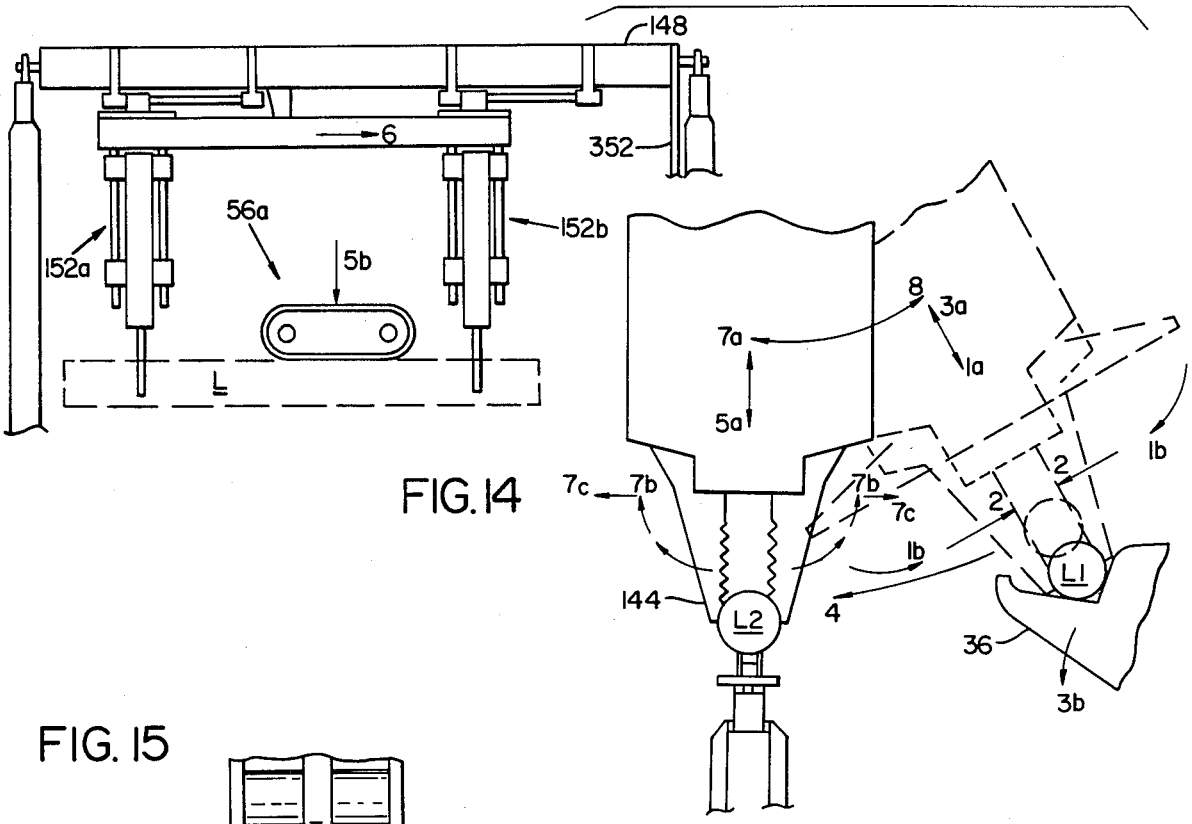
FIG. 14
FIG. 15
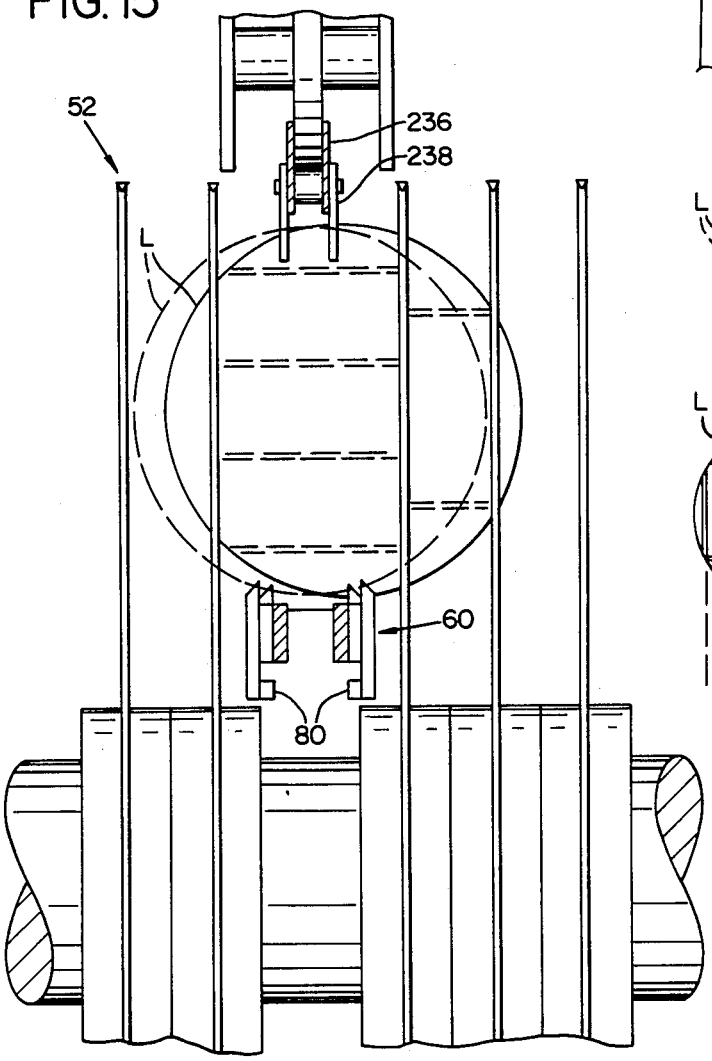
FIG. 16
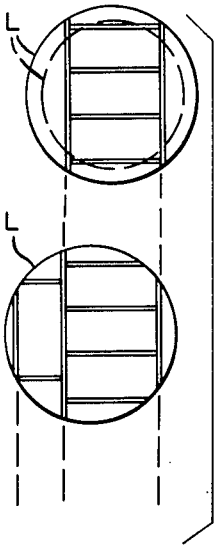
FIG. 17
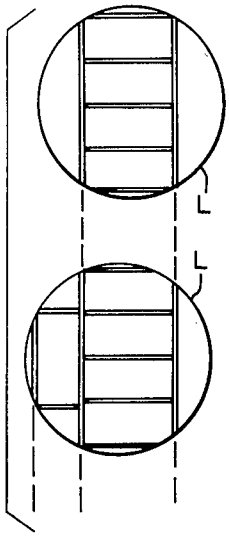

LUMBER MILL SYSTEM

BACKGROUND OF THE INVENTION

This invention relates generally to lumber handling and processing systems and more particularly to lumber mill systems especially suited for processing small logs.

As the cost of lumber has increased and once plentiful stands of large diameter timber have decreased, it has become increasingly necessary to harvest small diameter timber and to optimize the lumber recovery from such timber. Generally, small diameter timber, sometimes referred to as "mini-logs", have a diameter within the range of about 4 to 12 inches. Because of the relatively small yield per mini-log, economics requires that each log be processed quickly to achieve a high level of production.

Several machines have been used heretofore for processing mini-logs. One machine, known as the "Chip-N-Saw," has an endless conveyor formed in part from V-shaped lugs that supportively center the logs on the conveyor. An upper surface of each log is engaged by an endless, overhead, free-floating conveyor having interlocking C-shaped lugs which also serve to center the logs on the conveyor below. This conveyor system conveys the logs through a chipping machine which chips away the outer slabs, and then through a device which cuts a longitudinal notch or guide in the bottom of the logs. The notched log is then placed on an elongate, mating bar and run through a sawing mechanism or the like.

Another machine, known as the "Beaver," uses spiked "coleman" rolls to center the logs as they are fed through two sets of chipping heads. The first set of chipping heads slabs the top and bottom surfaces of each log, while the second set slabs the sides of the log. Multiple sets of tandem coleman rolls support opposite surfaces of the logs as they are fed through the chipping heads. At least one set of rolls grips the top and bottom surfaces of each log and at least one set grips the sides of the log.

A more recent development is the use of an endless "sharpes" chain conveyor to convey the logs through a sawing mechanism. Such conveyor carries a plurality of spaced teeth upon which the logs are impaled. Prior to impaling, each log is rolled to the preferred orientation and then centered on the conveyor. An overhead "thumper" roll then impacts the top surface of the log to impale it on the conveyor, following which the log is conveyed to the sawing mechanism. The sharpes chain conveyor works reasonably well with fairly large, heavy, straight logs, although there is still much room for improvement because the chain tends to twist about its longitudinal axis and the teeth tend to twist and rock in the log when a substantial force is applied to the log, as during sawing. Any unnecessary movement of the log during sawing makes the sawing operation less accurate.

This problem is exacerbated with small, light logs, misshapen logs and logs with hard spots, such as knots, aligned with the saw-blades because such logs are more prone to unnecessary movement on the conveyor chain during sawing. In addition, the downward force exerted by the saw blades on the front end of a fairly light log may cause the back end to raise, making the sawing operation even less accurate.

With each of the foregoing machines for processing logs into lumber, it is impossible as a practical matter to saw the logs along a vertical plane near the geometrical center or longitudinal axis of the logs. This is because these machines require some conveyance means to convey and support the logs through the sawing mechanism. Consequently, the saw blade(s) cannot be adjusted laterally to cut near the geometrical center of the centered logs without interfering with the conveyance means. Moreover, the machines are inherently incapable of conveying "off-center" logs to any reliable degree through the sawing mechanism. Thus, the ability to optimize the yield from mini-logs by adjusting the lateral position of the saw blades or otherwise is greatly restricted. For example, a centered log having a minimum diameter of 6.8 inches can be optimally processed to yield only three 2×4 boards. However, if the same log is sawed along a vertical plane only 0.8 inch from its geometrical center, it can be processed into four 2×4 boards, an increased yield of 33%. This illustration of the drawbacks of the foregoing continuous conveyor systems is even more significant when it is appreciated that the graphed distribution of harvested mini-logs is a bell curve peaking at a log diameter of about 7 inches.

Conventional "end dogging" systems do have the capacity to saw mini-logs near their longitudinal axis to optimize lumber recovery. They do so by gripping the logs laterally off-center relative to the system's longitudinal axis and then conveying the laterally offset logs through a sawing mechanism. Generally, such systems include an overhead carriage which travels on tracks and supports two end dogs for gripping the opposite ends of each log.

For example, U.S. Natural Resources, Corvallis, Oreg., manufactures an end dogging system, known as the "Log Boss System/Applied Theory", which includes log scanning means for measuring the diameter of each log and transmitting the data to a microprocessor programmed to determine the desired lateral offset of each log for optimum lumber recovery. The log is supported on a laterally movable cradle controlled by the microprocessor. The cradle offsets the log an amount determined by the microprocessor, following which the end dogs pick up the log and convey it through a three headed chipping canter. The canted log is then conveyed downstream by a linebar feed system for further processing through twin or quad bandmills. Other end dogging systems use a similar end dogging arrangement to convey the offset mini-logs through a sawing mechanism, rather than a chipping canter, to optimize lumber recovery.

Despite their high yield per mini-log, end dogging systems suffer from two major drawbacks. They are notorious for significantly lower production than most continuous conveyor type systems. Generally, end dogging systems are reciprocating type systems requiring that the end dogs transport each log downstream through the saw, release the log and then recycle back upstream to pick-up the next log. The recycling time is lost time which prevents the logs from being run through the saws essentially "end to end."

Equally important, such systems apply end pressure to the logs with little or no support for the midsection of the log. Consequently, all but the largest mini-logs tend to be somewhat unstable when subject to forces applied by the sawing mechanism during sawing. It is not unusual for mini-logs to run sideways up to an inch when one saw blade hits a knot in the log, resulting in less than optimum sawing accuracy. This problem is especially acute with small mini-logs, since the resistance of an end loaded column to bending is a function of its diameter to the fourth power. Thus, small mini-logs are much more prone to deflection during sawing than larger mini-logs.

Accordingly, there is a need for an improved lumber mill system capable of processing mini-logs, as well as larger logs, for optimum lumber recovery at a high production rate.

It is therefore one object of the invention to provide a lumber mill system capable of optimizing lumber recovery at a high production rate.

A more specific object of the invention is to provide a lumber mill system as aforesaid in which lumber recovery is optimized by laterally offsetting the logs, when appropriate, from the longitudional centerline of the conveyor means on which they are transported to the sawing mechanism.

Another object of the invention is to provide a system as aforesaid wherein the logs can be processed essentially end to end through the sawing mechanism.

Yet another object of the present invention is to provide a system as foresaid in which the lumber recovery per log is optimized without lateral adjustment of the saw blades.

A further object of the invention is to provide a system as aforesaid wherein off-center logs, misshapen logs and logs with hard spots, as well as centered logs, are firmly supported during sawing to resist unnecessary movement due to forces applied by the saw blades, thereby to promote increased sawing accuracy.

Still another object of the invention is to provide a system as aforesaid wherein the logs are firmly supported during sawing without end loading of the log.

Other objects and advantages of the invention will become apparent from the drawings and following detailed description.

SUMMARY OF THE INVENTION

In accordance with the foregoing objects, the present invention comprises a lumber mill system having endless conveyor means movable along a conveyor path and having a longitudinal centerline. It also includes a log loading means for loading logs one at a time onto the endless conveyor means and control means cooperable with the log loading means to control the amount of lateral offset which the log loading means applies to each log in loading it onto the conveyor means. The control means detects the diameter of each log to be processed, determines from such diameter how much, if at all, the log should be offset, and responsively controls the log loading means such that the log is loaded onto the conveyor means with its geometrical center (or longitudinal axis) laterally offset from the centerline of the conveyor means the predetermined amount.

The system includes an apparatus for loading logs one at a time onto the endless conveyor means. The loading apparatus includes a frame and pivot means for pivoting the frame about a pivot axis parallel to a longitudinal centerline of the conveyor means. It further includes axial carriage means supported by the frame for horizontal movement in the same direction as the conveyor means and at least one radial carriage means supported by said axial carriage means for movement toward and away from the pivot axis. Each radial carriage means supports a gripping means for gripping a circumferential portion of the log. The frame is pivoted about the pivot axis by an actuating means from a first position in which the gripping means is to one side of the conveyor means to a second position in which the gripping means is above the conveyor means.

The system also includes an overhead holddown apparatus to facilitate holding the log on the endless conveyor means. The holddown apparatus includes endless tooth carrying means movable along a conveyor path and carrying an endless row of spaced teeth. The tooth carrying means is positioned above the conveyor means and is supported for vertical movement by a supporting means. The tooth carrying means is movable between a retracted position and a holding position in which the teeth contact an upper surface of an underlying log being conveyed on the conveyor means.

The present invention incorporates a method of loading a log onto an endless, longitudinally extending conveyor means from the side comprising the following steps:

(1) gripping a log such that its longitudinal axis is parallel to the longitudinal axis of said conveyor means;

(2) pivoting the log along an arcuate path toward the conveyor means while keeping the longitudinal axis of the log parallel to the longitudinal axis of said conveyor means, the arcuate path intersecting a vertical plane extending upwardly from said conveyor means;

(3) stopping the arcuate travel of the log when it is positioned above said conveyor means;

(4) lowering the log onto said conveyor means while simultaneously moving the log downstream with and at the same speed as said conveyor means; and (5) releasing the grip on the log.

BRIEF DESCRIPTION OF THE DRAWINGS

In the drawings:

FIG. 14 is a diagramatic view illustrating the sequential movement of the log loading charger and farthest upstream holddown charger.

FIG. 15 is a partially sectional end view of a scragg saw, lower spike chain conveyor and holddown charger, illustrating the increased lumber recovery possible with the present invention.

FIG. 16 is a diagramatic end view comparing logs process through the scragg saw with and without a lateral offset.

FIG. 17 is view similar to that of FIG. 16, but comparing two larger logs.

DETAILED DESCRIPTION OF A PREFERRED EMBODIMENT

General Arrangement

Figures 1, 2:
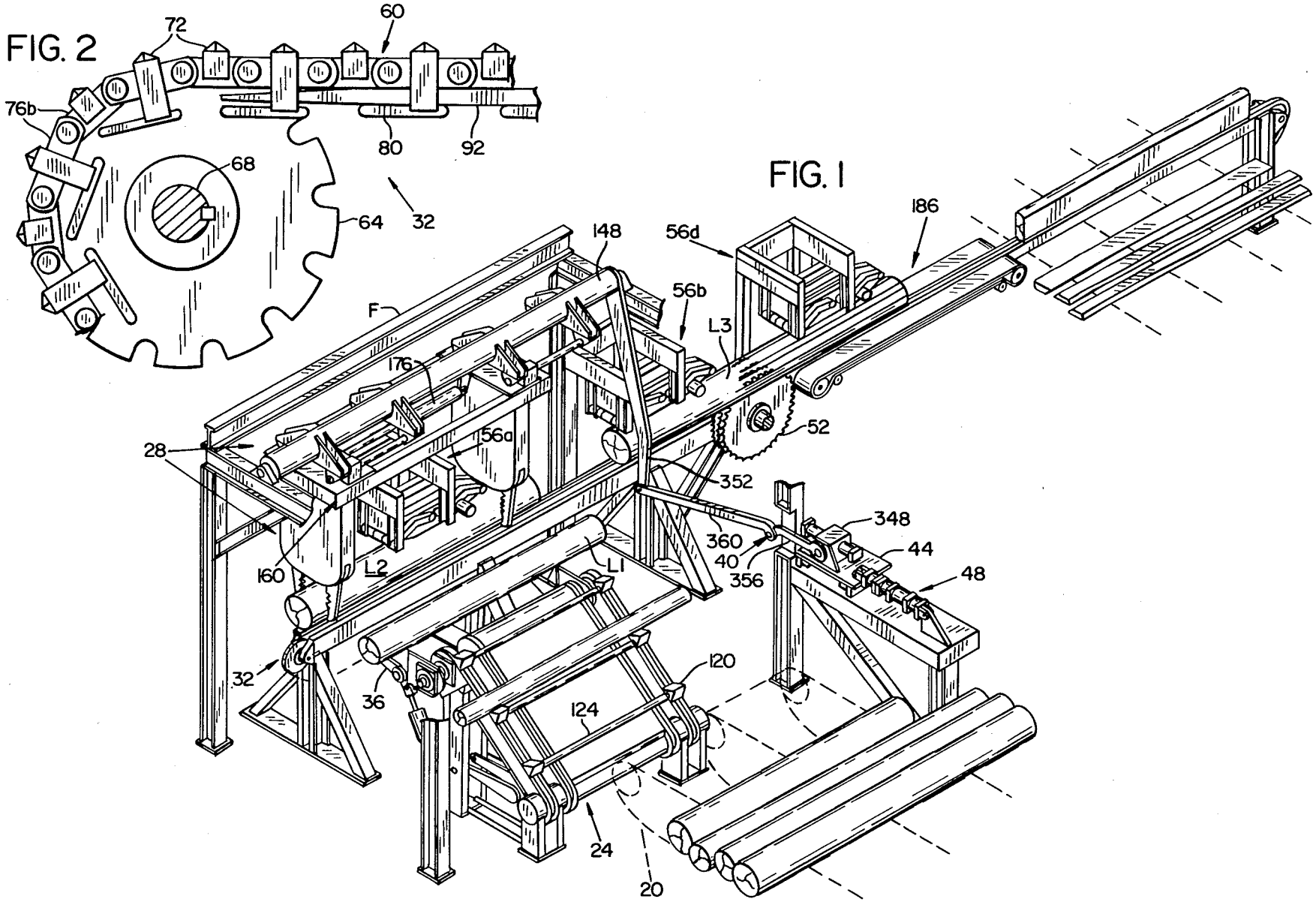
FIG. 1 is a perspective view of a lumber mill system in accordance with the present invention.
FIG. 2 is an enlarged side elevational view of an end portion of a lower spike chain conveyor of the system of Fig. 1, with some of the conveyor's support structure omitted.

Referring particularly to FIG. 1, a lumber mill system in accordance with the present invention includes a log infeed conveyor 20, log unscrambler 24, log loading charger 28 and endless conveyor means 32. Log infeed conveyor 20 feeds the logs to unscrambler 24 which separates and transfers the logs one by one to a log cradle 36. At this stage, the log is to the side of (laterally adjacent) the endless conveyor means. From there, each log L is gripped by charger 28, pivoted along an arcuate path towards conveyor means 32 and set thereon.

The pivoting movement of charger 28 is effected by an actuating means 40 including a movable base 44. An offsetting means, such as offset setworks 48, forms part of a control means for adjusting the lateral position of base 44 relative to the conveyor means, thereby to control how far actuating means 40 pivots charger 28 toward the conveyor means before the gripped log is set thereon. In this way, each log can be loaded onto the endless conveyor means with its geometrical center or longitudinal axis either vertically aligned with the longitudinal centerline of the conveyor means or laterally offset from such centerline a predetermined amount. The control means is programmed to calculate the amount of lateral offset, if any, necessary to optimize lumber recovery from data including the smallest measured diameter of the log.

Figures 3, 9:
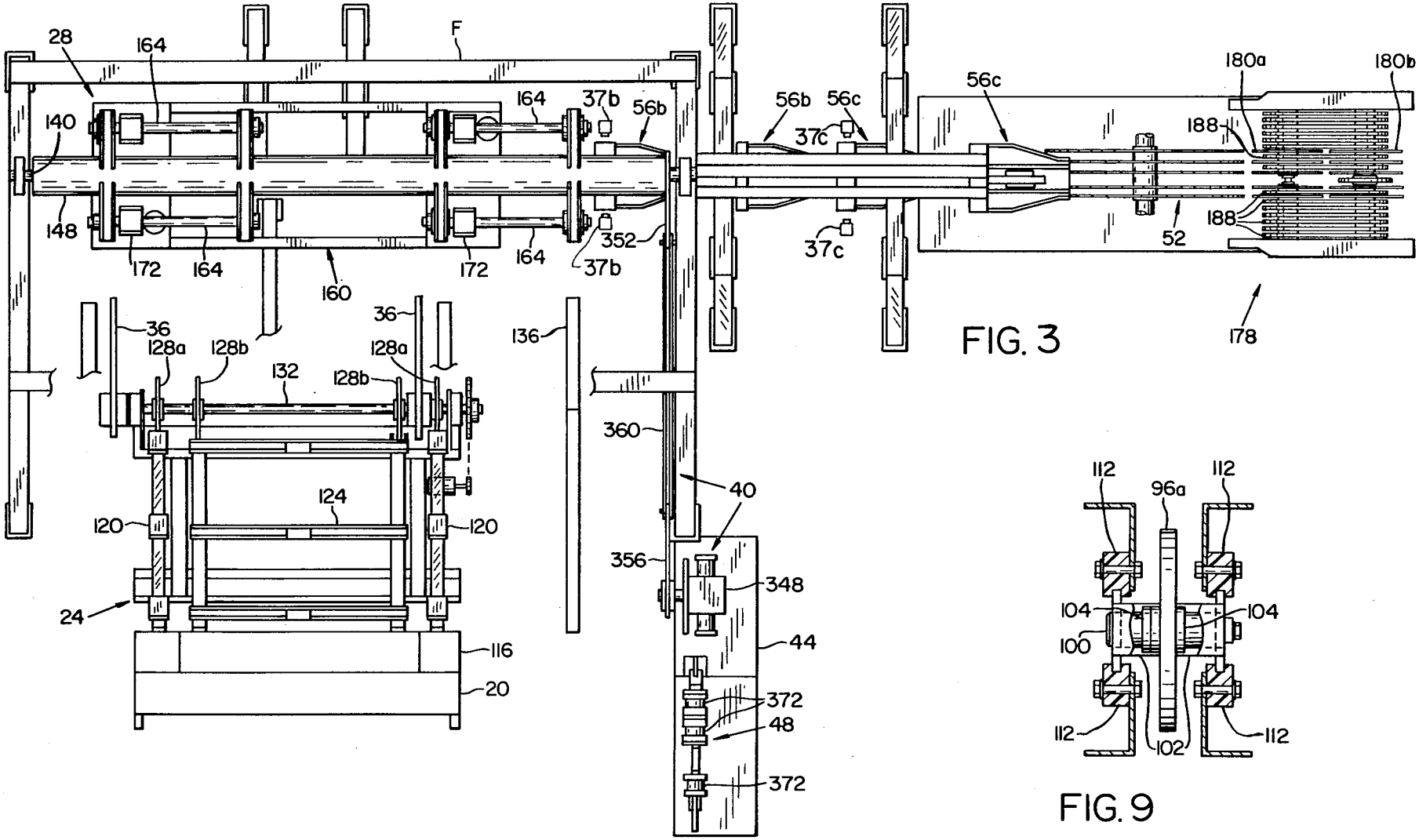
FIG. 3 is a top plan view of a slightly modified version of the system of FIG. 1 in which a third overhead holddown charger is positioned upstream rather than downstream of the sawing mechanism.
FIG. 9 is a sectional view taken along line 9—9 of FIG. 4.
Figures 4, 7, 8:
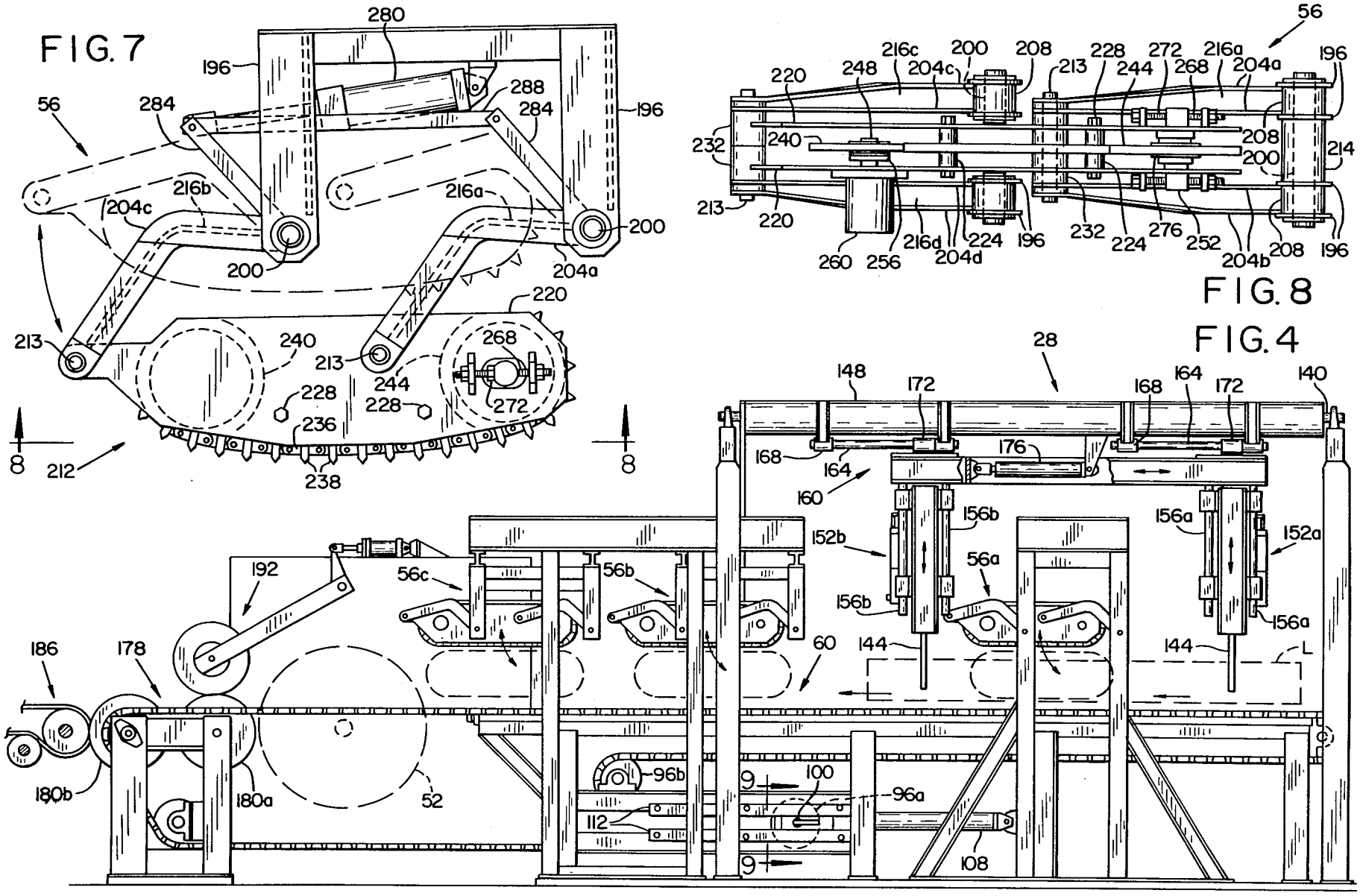
FIG. 4 is a side elevational view of the back side of the system of FIG. 3, with the addition of an outfeed holddown assembly and outfeeed conveyor omitted from FIG. 3 for the sake of clarity.
FIG. 7 is a side elevational view of an overhead holddown charger of the systems of FIGS. 1 and 3.
FIG. 8 is a view taken along line 8—8 of FIG. 7.

Once positioned on the endless conveyor means, the log is conveyed to a scragg saw 52 having a plurality of vertical saw blades or to some other lumber processing apparatus, such as a band mill, chipping head or the like. As the log is conveyed toward saw 52, a log holding means 56 applies a downward force to an upper surface of the log to hold the log firmly on the endless conveyor means for accurate sawing. The log holding means preferably includes a plurality of overhead holddown chargers **56*a*, 56*b*, 56*c* (FIGS. 3 and 4) vertically movable between a retracted position and a holding position in which the holding means grips or holds the upper surface of the log. A log holding means 56*d* may also be provided downstream of saw 52. Even with relatively short 8 foot logs, it is preferable to have at least three holddown chargers upstream of scragg saw 52, as shown in FIGS. 3 and 4, although two chargers will suffice (FIG. 1**). Downstream of the scragg saw, the cut center cant, flitches and slabs are handled and processed further in a known manner.

Endless Conveyor Means

Figure 6:
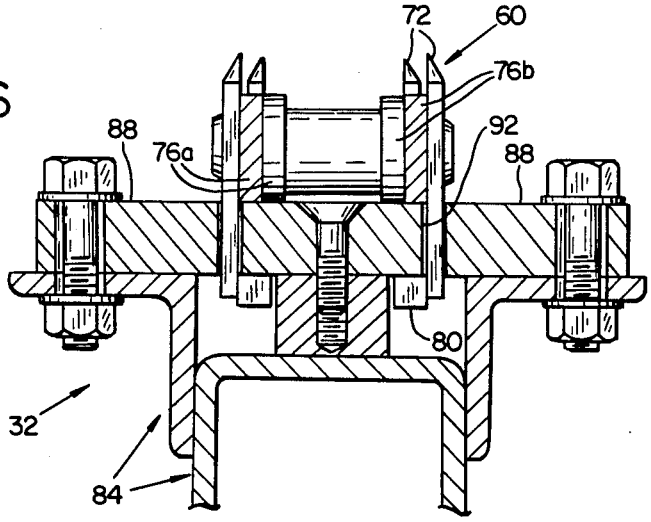
FIG. 6 is a vertical sectional view of the lower spike chain conveyor.
Figure 10:
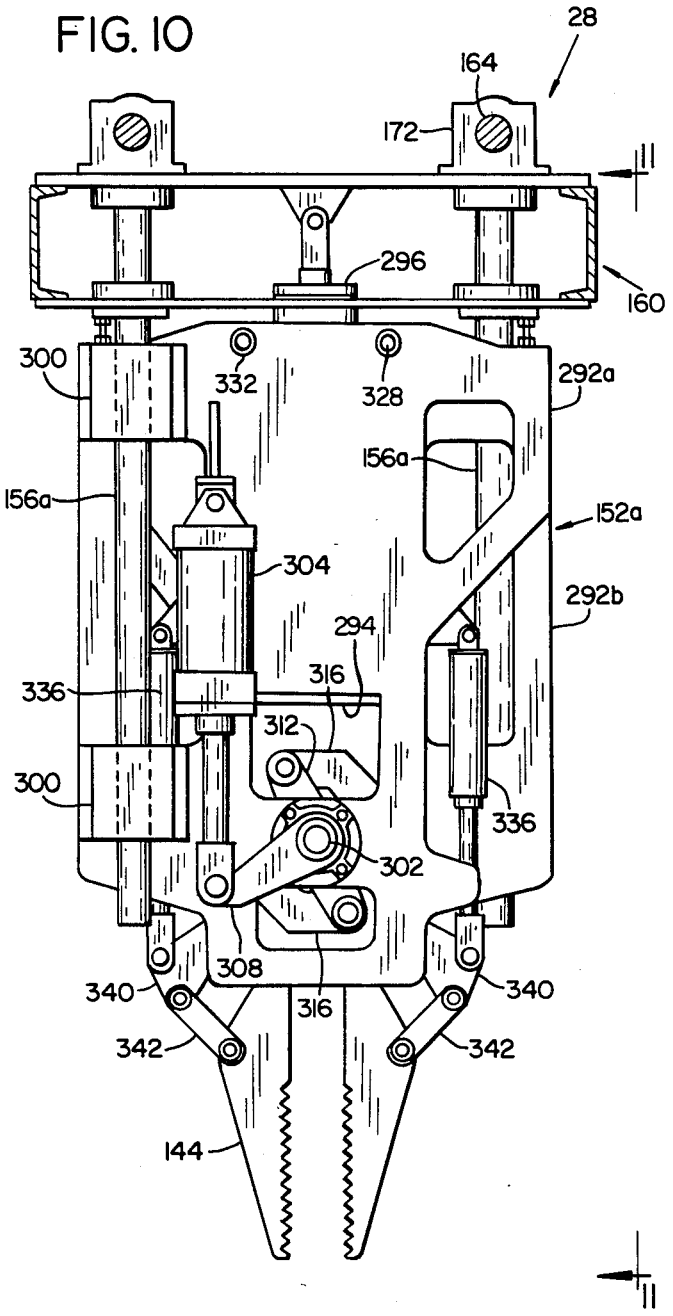
FIG. 10 is an elevational view of a vertical carriage of a log loading charger of the system of FIGS. 1 and 3.
Figure 11:
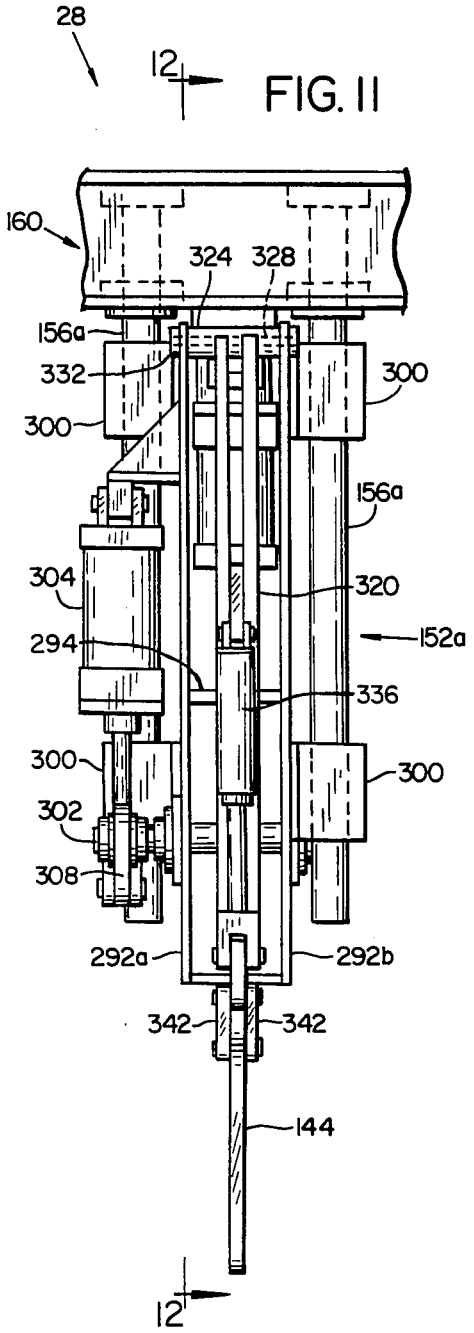
FIG. 11 is a view taken along line 11—11 of FIG. 10.

Referring to FIGS. 2, 4 and 6, endless conveyor means 32 will now be described. It includes a lower spike chain 60, drive sprocket 64 and drive shaft 68. Drive sprocket 64 drives spike chain 60 along a conveyor path about a longitudinally elongate frame and is keyed to drive shaft 68. Drive shaft 68 is driven by a drive means in a conventional manner.

Lower spike chain 60 is comprised of a pair of endless conveyor chains having interconnected links **76*a*, 76*b*, respectively. A plurality of uniformly spaced teeth 72 are welded to the outer surfaces of links 76*a*, 76*b* to form two rows of teeth. The two rows straddle the longitudinal centerline of the spike chain. As with conventional roller chain, links 76*a*, 76*b* are connected in laterally spaced relationship by pins. Teeth 72** impale themselves in the underside of the log when it is loaded onto the lower spike chain.

Each tooth 72 welded to an outboard link **76*a*, 76*b* has an extended base portion to which a stabilizing bar 80 is welded, such that every other tooth in both rows of teeth has a stabilizing bar (as shown in FIG. 2). The inboard links 76*a*, 76*b* do not have extended base portions. The extended base portions travel within one of two elongate guide channels formed between a pair of retainer bars 88 and an intermediate chain guide bar 92 upon which links 76*a*, 76*b* ride. Guide bar 92 supports the lower spike chain and any log carried thereon for the full length of the chain's downstream travel. Both guide channels are wide enough to permit the extended base portion of the teeth to travel therealong unimpeded but narrow enough to provide lateral support for such teeth and hence for the entire chain. Further lateral and torsional stability is provided by the stabilizing bars which ride in sliding contact (or at least in close proximity) with the underside of the guide bar. In this way, the lower spike chain is provided with substantial lateral and torsional stability, even when the log rides off-center on the chain. The endless conveyor means further includes an elongate support frame 84 (FIG. 6) to which retainer bars 88 and guide bar 92** are fastened by fastening means.

At the end of its downstream travel and on its return travel to drive sprocket 64, the lower spike chain is guided by three shaft-mounted sprockets, including sprockets **96*a*, 96*b* (FIG. 4). Sprockets 96*a*, 96*b* each reverse the direction of travel of the chain to provide a tortuous conveyor path along which a tension adjusting means operates. As best shown in FIG. 9, the tension adjusting means includes a retainer shaft 100, shaft-supporting sleeves 102, and sprocket hubs 104, as well as sprocket 96*a*. Hubs 104 mount sprocket 96*a* to shaft 100. The adjustment means also includes an air cylinder 108 (FIG. 4) mounted at one end to a fixed frame and at its other end to sleeves 102. Cylinder 108 is actuable to tighten or loosen the tension of the lower spike chain by shifting longitudinally the axis of shaft 100. Two pairs of upper and lower guide bars 112, preferably made of UHMW or like material, provide a support structure for sleeves 102 that permits longitudinal shifting of the sleeves and hence sprocket 96*a***. Each guide bar is in turn fastened to a strip of angle iron that serves as a guide for the spike chain.

Sprocket **96*b* is driven by a drive means, such as a hydraulic motor, in a conventional manner to reduce the power required to drive sprocket 64**.

Infeed Means and Log Loading Charger

Figure 5:
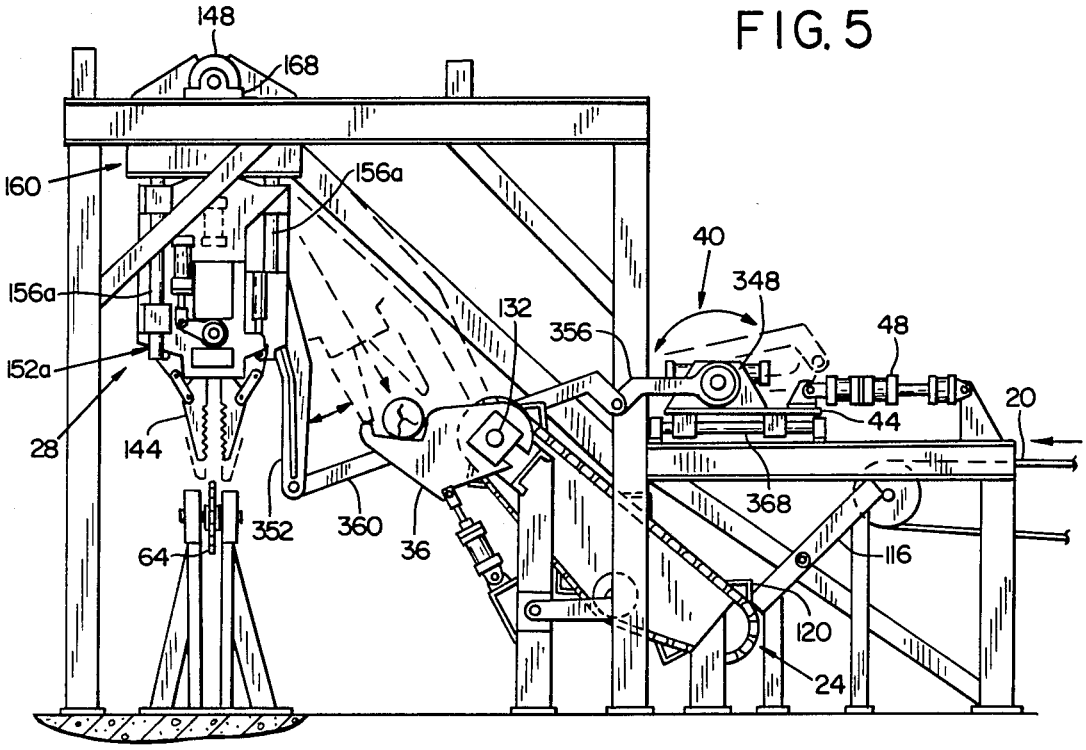
FIG. 5 is an end elevational view of the system of FIGS. 1 and 3.

Referring particularly to FIGS. 3, 4 and 5, log infeed conveyor 20 and log infeed unscrambler 24 form part of an infeed means which prepares the logs for loading onto the lower spike chain. The infeed means also includes an inclined skid deck 116 (FIG. 3) which directs the logs from the infeed conveyor to the unscrambler where flights of tandem lugs 120, driven by a pair of widely spaced endless chains, transport the logs individually up an inclined plane to log cradle 36. Each flight also includes a lug bar 124 spanning much of the gap between the lugs of each flight. The lug bars, also driven by a pair of endless chains, serve to keep the logs horizontal on the flights as they are conveyed up the inclined plane. Sprockets 128*a*, 128*d* and sprockets 128*b*, 128*c* drive the endless chains of the lugs and lug bars, respectively. These sprockets are all driven by a common shaft 132 in a conventional manner.

As the logs are transported by the unscrambler to the log cradle, logs having a length in excess of eight feet may be partially supported by an inclined log support 136 (FIG. 3). Once the log reaches the cradle, it may be rotated to the preferred orientation by short spiked endless chains (not shown) associated with the horizontal and vertical legs of both cradle arms of cradle 36 in a known manner.

Each log remains in the cradle until log loading charger 28 grips the log with two pairs of clamp arms 144 and lifts it off the cradle. After a pause to permit the preceding log (L2)(FIG. 1) to move sufficiently downstream on the lower spike chain to make room for the next log (L1)(FIG. 1), the log loading charger pivots about a support shaft 140, from the dashed to solid line positions depicted in FIG. 5, to position the log above the lower spike chain, and then lowers the log onto the spike chain. It then pivots back toward the cradle to pick up the next log.

During this operation, the log loading charger or log loading means actually undergoes three types of movement. First, the entire log loading charger, which includes a pivot tube 148 rotatably supported by shaft 140, pivots about the axis of shaft 140 to swing the log above the lower spike chain to unload the log and then back toward the cradle to pick up the next log. Pivot tube 148 defines a pivot axis that is parallel to and in the same vertical plane as the longitudinal centerline of the conveyor means.

Second, the loading charger has a pair of radial carriages 152*a*, 152*b* that move radially of support shaft 140 on tandem radial guide shafts 156*a*, 156*b*, respectively. In this way, the clamp arms can be radially extended to grip the log in the cradle, as illustrated by the dashed arrow of FIG. 5, retracted radially so that the charger can swing the gripped log above the spike chain, and then extended radially once again to lower the log onto the spike chain.

Finally, as best shown in FIGS. 3 and 4, the log loading charger includes a horizontal or axial carriage 160 movable on horizontal support shafts 164 which permit carriage 160 to move horizontally downstream with the lower spike chain. Shafts 164 are supported at their ends by pillow block bearings 168 secured to pivot tube 148. Carriage 160 is slideably supported on shafts 164 by carriage guides 172. The axial carriage is powered by a hydraulic cylinder 176 secured at one end to the carriage frame and at the other end to a bracket welded to the pivot tube. It supports both radial carriages and hence any log gripped by the clamp arms of such carriages. The axial carriage is controlled to move at essentially the same speed as the lower spike chain when the vertical carriages are extended radially to lower the log onto the lower spike chain. Thus, there is essentially no relative movement between the log and moving spike chain during loading, except for the downward movement of the vertical carriages. In this way, the log can be impaled on the spike chain without the teeth making longitudinal cuts in the log.

Overhead Holddown Chargers, Sawing Mechanism and Outfeed Means

As the axial carriage moves downstream with the spike chain and the vertical carriages move downwardly toward the spike chain to load the log onto the chain, overhead holddown charger 56*a* moves simultaneously downward, contacting the upper surface of the log at about the time the log becomes impaled on the lower spike chain or just prior thereto. As described more fully below, holddown charger 56*a* includes an endless tooth carrying means which serves to hold and support the log on the lower spike chain.

As the log moves downstream of charger 56*a*, chargers 56*b*, 56*c* each move independently downwardly from a retracted position to a holding position to contact a leading end portion of the log once such portion travels underneath the charger. Each charger then returns to its retracted position once the trailing edge of the log clears the charger.

Just downstream of holddown charger 56*c*, the lower spike chain conveys the log through scragg saw 52 which is comprised of a plurality of laterally spaced, vertical blades driven by a common shaft. The blades may be stationary, with the lateral position of the blades fixed, since the present invention optimizes lumber recovery by offsetting the log laterally on the lower spike chain to vary the relative lateral orientation of the log and saw blades.

As shown in FIGS. 3 and 4, downstream of the scragg saw the cants are maintained upright by an outfeed means including an outfeed assembly 178 comprised of sets of tandem discs 180*a*, 180*b* driven by common shafts 184*a*, 184*b*, respectively. Each set of tandem discs is aligned laterally with one of the saw blades and hence the kerf cut in the log by such saw blade. Each individual cant is conveyed upright by a conveyance means between two adjacent discs 184*a* and then two adjacent discs 184*b* before being fed to an outfeed conveyor 186. Every cant except the center cant, which continues to be conveyed downstream by the lower spike chain, is conveyed through the outfeed assembly by a plurality of endless outfeed chains 188 supported on sprockets mounted to shafts 184*a*, 184*b*. A single chain is provided between each pair of adjacent discs, except for the two discs straddling the lower spike chain. Several endless chains 188 are provided outboard of the outermost discs to carry away the outer slabs.

The outfeed means further includes a holddown assembly 192 having a holddown roll. The holddown roll, positioned just downstream of the scragg saw, keeps the cants from lifting as they exit the saw. Alternatively, an additional holddown charger 56*d* may be substituted for the holddown assembly, as shown in FIG. 1. Downstream of outfeed assembly 178 the cants may be sorted and otherwise processed in a known manner.

The construction of holddown chargers 56*a, b, c, d* will now be more specifically described with reference to FIGS. 7 and 8. Each charger 56 includes a support frame having a plurality of vertical support members 196. Support members 196 support one long and two short pins 200 about which four support arms 204*a, b, c, d* pivot. Each support arm is pivotally connected at one end by a collar 208 to one of pins 200 and at its other end to a pin 213 supporting an endless tooth carrying means 212. In the case of the long pin 200, which supports two of the clamp arms, a support sleeve 214 welded to the two central support members is provided to further support the midsection of the pin. Each support arm is comprised of two arm portions joined by an intermediate web portion 216 (*a, b, c* or *d*).

The endless tooth carrying means includes a pair of side plates 220 connected together in laterally spaced relationship by a pair of spacing sleeves 224 and fastening means 228 (such as a bolt and nut). Each side plate 222 has two collars 232 welded thereto, one for pivotally connecting the side plate to the upstream pin 213 and the other for connecting the side plate to the downstream pin 213. The side plates support therebetween an endless overhead spike chain 236 having uniformly spaced sticker teeth 238 for penetrating the upper surface of the log. As with the lower spike chain, the overhead spike chain carries two laterally spaced rows of teeth (see FIG. 15). Both rows of teeth travel along a circulating path that is vertically aligned with the conveyor path of the conveyor means teeth.

Upper spike chain 236 travels on sprockets 240, 244 which are supported by a drive shaft 248 and support shaft 252, respectively. Shafts 248, 252 are in turn supported by the side plates. Sprocket 240, connected to shaft 248 by a taper lock hub 256, is driven by a hydraulic motor 260.

Sprocket 244 forms part of a tension adjustment means that adjusts the tension of spike chain 236 by shifting the axis of shaft 252 longitudinally. The tension adjustment means includes a pair of threaded rods 260 secured to side plates 222. Each rod extends through a bore drilled near one end of shaft 252. The adjustment means further includes a nut 272 associated with each rod which threadably engages the rod in abutting contact with the shaft. Adjustment of nuts 271 causes the axis of the shaft to shift logitudinally, thereby to tighten or loosen the tension of the overhead spike chain, depending on the direction of adjustment. Once the desired tension is set, sprocket 244 rotates on a cartridge bearing 276 secured to shaft 252.

The holddown charger is pivoted either upwardly or downwardly by an air cylinder 280 operating through an actuating linkage means including four parallel actuating links 284 and two parallel connecting links 288. Links 288 each pivotally interconnect one upstream actuating link 284 to one downstream actuating link 284. One end of each actuating link is welded either to one of the collars 208 or, alternatively, directly to one of the clamp arms (as shown in FIG. 7), such that each actuating link and its associated clamp arm pivot as one. Thus, when the piston rod of cylinder 280 is extended or retracted, all four support arms pivot synchronously about such pins as one unit. It will be appreciated that the actuating and connecting links define a three dimensional parallelogram linkage with endless tooth carrying means 212 being the fourth link. Viewed from another perspective, support arms 204*a–d* and tooth carrying means 212 define a three dimensional parallelogram linkage with the frame (including support members 196) being the fourth link.

As a result, the teeth of overhead spike chain 236 always remain essentially parallel (horizontal) with the lower spike chain and in single-point contact with the transported log. One and perhaps two teeth in each row of the overhead chain will penetrate the most elevated point of that portion of the log's upper surface beneath the charger, leaving the remaining teeth essentially free of contact with the log. The penetrating tooth (or teeth) travel downstream with the log until such time as they are recirculated back to the upstream end of the charger, or until the upstream teeth penetrate an even higher point in the log's upper surface. In the latter event, the charger pivots upwardly to a higher horizontal plane, causing the downstream penetrating tooth (teeth) to pull away from its penetrating contact with the log. In this way, the overhead spike chain maintains essentially single point contact with the upper surface of the log.

Radial Carriages of Log Loading Charger

Referring to FIGS. 10, 11, 12 and 13, the radial carriage 152*a* of the log loading charger will be described, the construction and operation of which is the same for carriage 152*b*. Carriage 152*a* includes two vertical support plates 292*a*, 292*b* joined together by a plate 294 welded to both support plates. An air cylinder means 296, disposed between the plates is pivotally connected at one end to plate 294 and at its other end to horizontal (axial) carriage 160. Cylinder means 296 operates to move the radial carriage toward and away from carriage 160 on tandem radial guide shafts 156*a*. The vertical carriage is guided on shafts 156*a* by radial carriage guides 300 welded or otherwise secured to the support plates.

Figure 12:
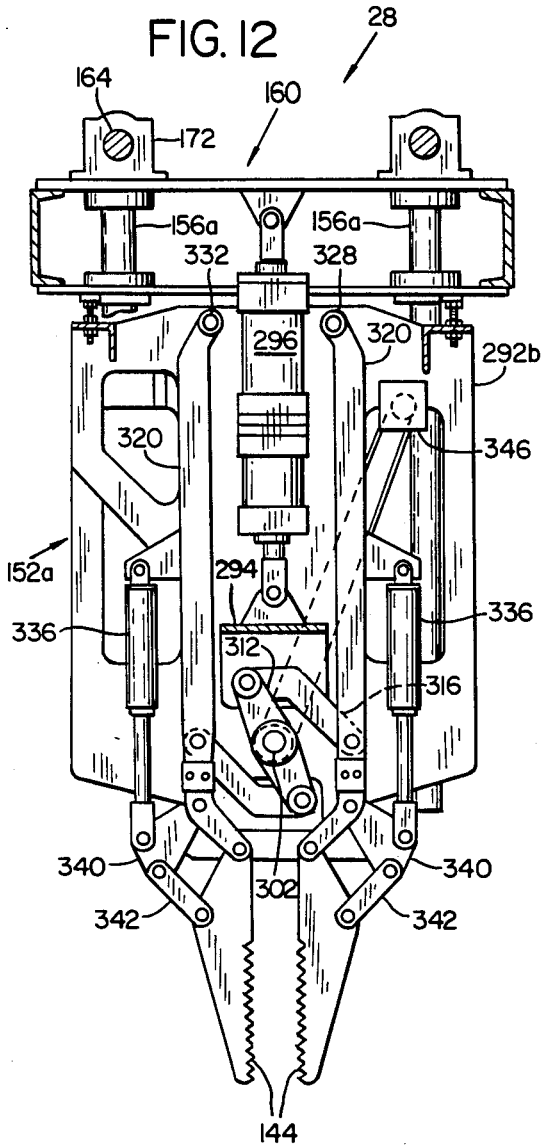
FIG. 12 is a sectional view taken along line 12—12 of FIG. 11.
Figure 13:
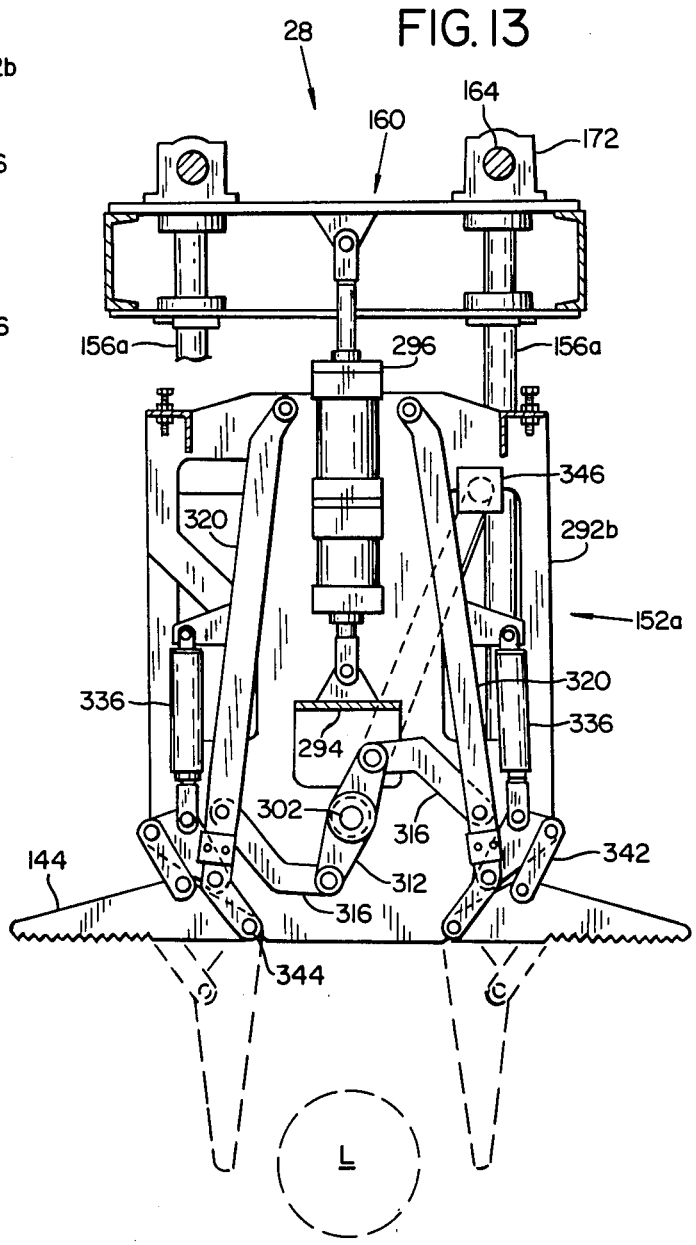
FIG. 13 is similar view to FIG. 12, but showing the clamp arms in an open position.

Radial carriage 152 supports clamp arms 144*a* with a linkage means that permits the clamp arms to undergo two types of movement. First, the linkage means includes a clamp arm actuating shaft 302, actuating shaft control cylinder 304 (FIGS. 10 and 11), pivot arm 308 (FIGS. 10 and 11), rotary arm 312, control links 316, and elongate pivot arms 320 (FIGS. 12 and 13). One control link 316 and pivot arm 320 is associated with each clamp arm. Each pivot arm 320 is welded to a sleeve 324 spanning the space between the two support plates. Each sleeve 324, and its associated pivot arm, pivots about a pin 328 secured to the support plates by collars 332. Extension or retraction of the control rod of cylinder 304 causes pivot arms 308 to rotate arm 312 about actuating shaft 300 which, in turn, causes both pivot arms 320 to pivot about their associated pins 328. Because the pivot arms are elongate, this causes the clamp arms, each of which is pivotally connected by a pin 344 (FIGS. 12 and 13) to a lower end of one of the pivot arms, to move essentially transversely toward or away from one another, depending upon the direction of rotation of shaft 300.

Second, the linkage means also includes a clamp arm control cylinder 336, control plate 340 and connecting link 342 associated with each clamp arm. Cylinder 336 is pivotally connected at one end to a bracket welded to pivot arm 308 and at the other end to control plate 340. Connecting link 342 pivotally interconnects the control plate and clamp arm. Thus, extension or retraction of the control rods of both cylinders 336 causes the clamp arms to pivot essentially about their respective pins 344. Thus, for example, extension of the control rod would cause the clamp arms to pivot from the solid to dashed line positions of FIG. 13.

A shaft encoder 346 (FIGS. 12 and 13) operably connected to shaft 302 by an endless chain records the diameter of each log gripped by the clamping arms. The diameter is a function of the amount of rotation of shaft 302 required to move the clamp arms into gripping contact with the log. This information is transmitted electronically to the control means.

Cylinder means 296 is actually two separate air cylinders joined together, with the lower cylinder acting as a damping means to insure that any log gripped by the charger is not forced downwardly onto the lower spike chain with excessive force.

Charger Actuating Means and Offsetting Means

Figure 18:
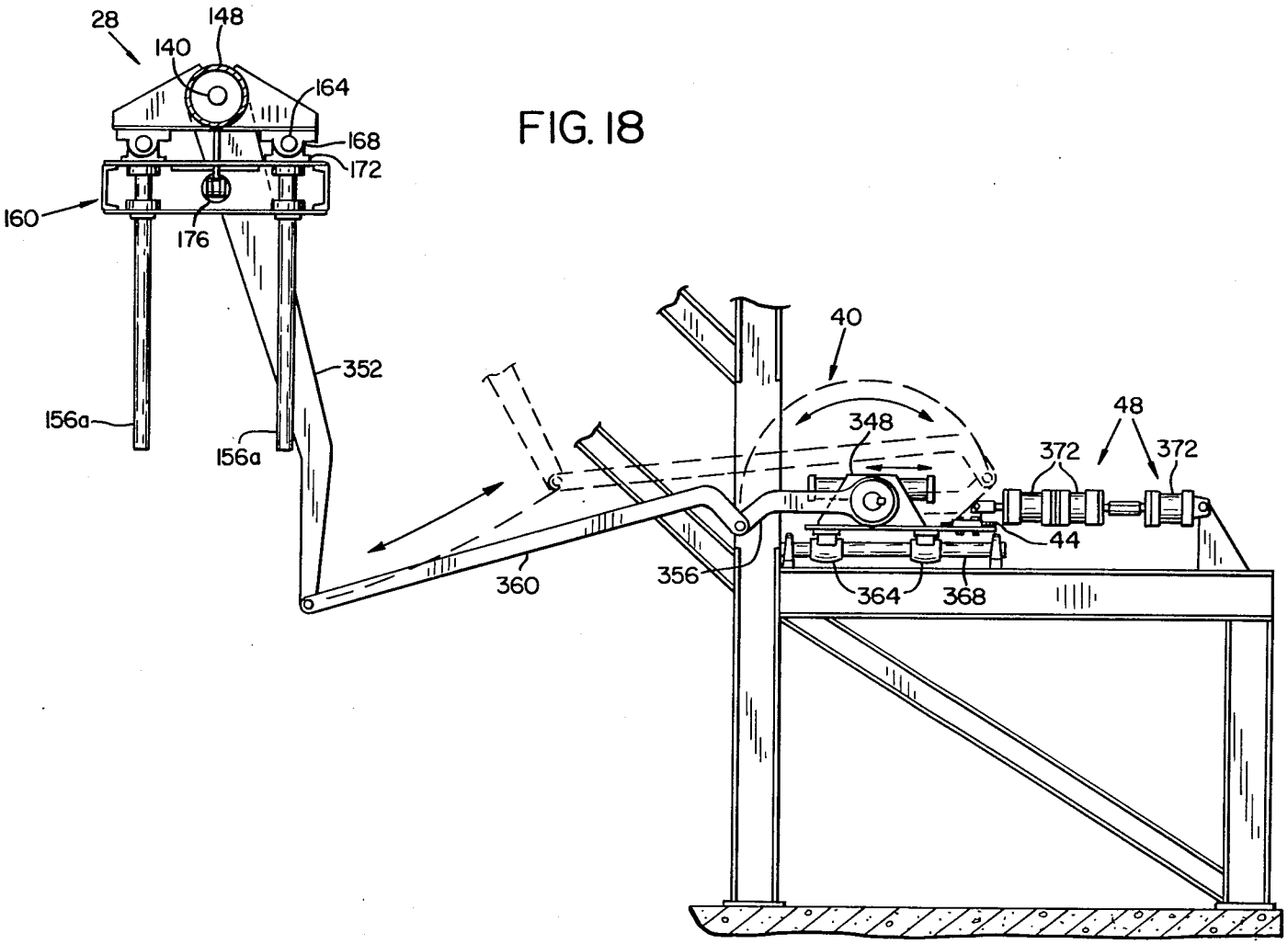
FIG. 18 is an end elevational view of the pivoting and offsetting mechanisms of the system of FIGS. 1 and 3.

With reference to FIG. 5 and particularly FIG. 18, the log loading charger actuating means will now be described. Actuating means 40 includes a rotary actuator 348, such as the "Flo-tork" actuator distributed by Amfac Fluid Power, Portland, Oreg., and linkage means interconnecting actuator 348 to a pivot arm extension 352 of pivot tube 148. The linkage means includes a rotary actuator arm 356 keyed to a drive shaft of actuator 348 and connecting link 360 pivotally interconnecting arm 356 and pivot arm extension 352. The rotary actuator rotates rotary arm 356 through an arc of about 180°, as illustrated by the arrow of FIG. 18, causing pivot arm 352 to pivot about shaft 140 between the solid and dashed line positions illustrated in FIG. 18 (depending upon the direction of rotation of arm 356). In this way, the entire log loading charger assembly can be swung or pivoted about shaft 140 from a log unloading position in which the charger assembly is essentially above the lower spike chain and to a log pick-up position in which the charger assembly is to one side of the lower spike chain and in position to pick up a log from the log cradle.

The log unloading position of the charger's clamp arms can be adjusted laterally relative to the underlying spike chain by moving the base 44 of actuator 348 toward or away from the spike chain. Base 44 rides on journal bearings 364 supported by an actuator support shaft 368. Movement of the base on shaft 368 is accomplished by an offsetting means including offset setworks 48. The offset setworks is comprised of a series of stacked air cylinders 372, some of which may be joined by a joining nut, capable of incremental adjustment. It is connected at one end to a fixed support and at the other end to a flange secured to base 44. It has been found that a stacked cylinder arrangement capable of adjustment in increments of 0.2 inch for a maximum adjustment of 1.0 to 1.4 inches works well for mini-logs having a diameter in the 5 to 15 inch range.

In operation, extension or retraction of one or more of the stacked cylinders causes the axis of rotation of arm 356 to shift laterally relative to the lower spike chain. This shift effects how far pivot arm 352 pivots toward the lower spike chain which in turn effects the relative lateral orientation between the clamp arms (and any log gripped by the clamp arms) and the lower spike chain. Because the clamp arms have a relatively large pivot radius, any shift of actuator 348 in inches will only nominally effect the relative vertical orientation between the clamp arms and lower spike chain.

System Operation and Control Means

Unscrambled logs are fed one at a time to log cradle 36 and rotated to the preferred orientation as earlier described. These operations may be controlled automatically or semi-manually by a foot switch or the like. Once oriented, the log is ready to be loaded by the log loading charger onto the lower spike chain. Again, the log loading charger is triggered either automatically or semi-manually. Once the loading cycle of the log loading means or charger is triggered, its operation is preferably automatically controlled by a control means as herein described.

The control means includes a microprogrammable processor such as the model EP-7, manufactured by Encoder Products, Inc., Sand Point, Idaho. FIG. 14 illustrates the Processor controlled sequential movement of charger 28 and overhead holddown charger 56*a*, beginning with the charger in the log pick-up position illustrated by the dashed line. The processor actuates cylinder 296 to move radial carriages 152*a*, 152*b* toward the log, as indicated by arrow 1*a*. Cylinders 336 of both carriages are simultaneously actuated to pivot clamp arms 144*a*, 144*b* about pins 316 (FIGS. 12 and 13) as illustrated by arrows 1*b*.

Next, cylinder 304 is actuated to move the clamp arms toward one another to grip the log therebetween, as depicted by arrow 2. Radial carriages 152*a*, 152*b* are then retracted radially (arrow 3*a*) while the cradle is pivoted downwardly (arrow 3*b*) by a cylinder means, also controlled by the control means. The log loading charger then pauses until the preceding log has moved sufficiently downstream on the lower spike chain to avoid interference. During this time, the log diameter measured by both shaft encoders 346 is transmitted to the processor. The processor is programmed to calculate the desired lateral offset, if any, of the log to optimize lumber recovery. The calculations are based on the smallest measured diameter of the log. The arrangement of the scragg saw including the spacing and positioning of the blades relative to the longitudinal centerline of the lower spike chain, is also taken into account. The optimum lateral offset is calculated in increments of 0.2 inch, although other increments may be used.

With the amount of lateral offset, if any, calculated, the control means actuates offset setworks 48 to move base 44 the desired incremental amount. A photoelectric sensor generates an electrical signal once the log has moved sufficiently downstream to clear the log loading area, thereby triggering rotary actuator 348 to pivot the log loading charger to its log loading position (as illustrated by arrow 4). At this stage, the longitudinal center of gravity of the gripped log is laterally offset from the longitudinal centerline of the lower spike chain by the calculated amount (if any). The control means then actuates cylinders 296 to move carriages 152*a*, 152*b* essentially downwardly toward the lower spike chain (arrow 5*a*). Overhead holddown charger 56*a* is simultaneously actuated by cylinder 280 to pivot downwardly toward the upper surface of the log (arrow 5*b*) and motor 260 begins to circulate overhead spike chain 236 at the same speed as the lower chain.

Shortly thereafter, the control means triggers horizontal carriage 160 to move downstream on shafts 164 (arrow 6), also at the same speed as the lower chain. The overhead spike chain of the holddown charger supportively contacts the upper surface of the log at about the same time or just before carriages 152*a*, 152*b* impale the log on the lower spike chain.

The clamp arms of the log loading charger continue to grip the log for a short time as the log travels on the lower spike chain. Then, as carriage 160 reaches the limit of its downstream travel, the clamp arms are moved away from the log, as indicated by arrows 7*b* and 7*c*, and carriages 152*a*, 152*b* are retracted (arrow 7*a*). In this way, the log is transferred smoothly from the clamp arms of the log loading charger to the lower spike chain. Moreover, once the clamp arms release their grip on the log, the log remains firmly held on the lower spike chain by the teeth of the lower and overhead spike chains. Upon releasing the log, the charger returns to its "log pick-up" position (arrow 8), where it is ready to pick-up the next log.

As the log travels downstream on the lower spike chain from the log loading area or station, one and perhaps two pairs of adjacent teeth of overhead spike chain 56*a* ride in penetrating contact with the highest point of that portion of the log's upper surface beneath the spike chain. If the chain encounters an even higher point on the log's surface, the entire headrig charger moves upwardly from one horizontal plane to another, establishing another essentially single-point contact with the log. Before the trailing edge of the log passes underneath charger 56*a*, the next downstream holddown charger 56*b* has already moved downwardly to contact the log so that the upper surface of the log is gripped at all times by at least one holddown charger. The operation of holddown charger 56*b* is triggered by the leading edge of the log breaking a light beam between two photoelectric sensors 37*b* (FIG. 3). This photoelectric sensor also triggers the log loading charger to swing towards the lower spike chain with the next log. Any chargers downstream of charger 56*b*, such as chargers 56*c* and 56*d*, operate in the same manner as charger 56*b*.

It will be apparent from the foregoing that the lower and overhead spike chains, by gripping the top and bottom surfaces of each log, provide substantial support to resist other than downstream movement of the log, even when the log is subject to considerable lateral forces. Any movement of the log other than in the downstream direction is unnecessary and undesireable. Without the overhead spike chain conveyor, which grips the top surface of the log, the log would be subject to lateral rocking or other unnecessary movement, even on a sharpes chain conveyor, and unable to resist with other than its own weight the downward force of the saw blades on the forward portion of the log. Moreover, the overhead and lower spike chains together provide such firm support for the conveyed logs that even off-center logs, bowed or otherwise misshapen logs, and logs with hard spots aligned with the saw blades can be sawed accurately with minimal unnecessary movement during sawing. At least one tooth of the overhead spike chain supports the upper surface of the log at all times traveling with the log undisturbed until another tooth (or teeth) take its place.

Equally important, the foregoing log conveying system is capable of firmly supporting off-center logs without applying pressure to the ends of the logs. Thus, the log conveying system of the present invention is much less prone to having logs run sideways during sawing as compared to end dogging systems.

It will also be apparent that the parallelogram linkage of the holddown charger permits the overhead spike chain teeth to move only vertically relative to the underlying log. The teeth cannot become loose in the log by rocking or twisting, a condition that would permit some unnecessary movement of the log during sawing.

Because the present invention provides greater stability for virtually all types of logs, saw accuracy is improved.

FIGS. 15–17 illustrate the manner in which the present invention optimizes lumber recovery. The dashed line of FIG. 15 depicts the orientation of a log with a diameter of about 7 inches centered on the lower spike chain. In that position, the two centralmost saw blades cut away two outer slabs, leaving a four inch wide cant suitable for processing downstream into three 2×4 studs. The outer slabs are not wide enough to be processed into other than chips. However, by laterally offsetting the log by about 0.8 inch, as depicted by the solid line, one of the outer slabs can be processed into an additional 2×4 stud, resulting in an increased yield about 33%. FIG. 16 illustrates the same comparison for a log (again with a diameter of about 7 inches) that has been shifted laterally to the left instead of right.

FIG. 17 shows a similar comparison for a log with a diameter of about 7.5 inches. When centered, the log can be processed into four 2×4 studs. However, with a lateral offset of 0.4 inch, an additional 2×4 stud is produced from one of the outer slabs, resulting in a 20% increase in yield.

The present invention is capable of laterally offsetting mini-logs by slightly over one inch and still firmly supporting the log during sawing. However, as the foregoing examples illustrate, offsets of even an inch or less can result in a substantial increased yield. Such increased yields are accomplished with a relatively simple sawing operation in which a plurality of stationary, vertical saw blades are positioned such that the two centralmost blades are spaced apart about four inches, with the remaining blades positioned outwardly from the centralmost blades in 2 inch increments. Other more sophisticated sawing operations might produce even further increased yields using the basic principles of the present invention. Moreover, such principles could be applied to larger logs, which are likely capable of being offset by more than one inch.

It will be apparent from the table below that as the diameter of the log increases, there are certain diameter ranges in which offsetting is of no benefit. However, with any given log, lumber recovery can usually be increased by offsetting, particularly since the normal distribution of mini-logs includes more logs in the 7 inch diameter group than any other group. The table below illustrates one preferred way in which the processor may be programmed to determine lateral offset as a function of the diameter of the log and foregoing saw arrangement. The percentage increase in lumber value due to offsetting may be slightly less than the increased yield because of increased wanes in the studs produced.

TABLE I

Comparison of Off-Center and Centered Logs Processed With ⅛ Inch Edger Kerf and 3/16 Inch Scragg Kerf

| Log Diameter | Lateral Offset | Yield With Offset | Yield Without Offset | Increased Yield |
|---|---|---|---|---|
| 3.8 | 0 | 1 - 2 × 4 | 1 - 2 × 4 | 0% |
| 4.4 | 0 | 2 - 2 × 4 | 2 - 2 × 4 | 0% |
| 5.6 | 0 | 3 - 2 × 4 | 3 - 2 × 4 | 0% |
| 6.8 | 0.8 | 4 - 2 × 4 | 3 - 2 × 4 | 33% |
| 7.1 | 1.0 | 3 - 2 × 4 | 3 - 2 × 4 | 50% |
| | | 1 - 2 × 6 | | |
| 7.5 | 0.4 | 5 - 2 × 4 | 4 - 2 × 4 | 20% |
| 7.7 | 0.5 | 4 - 2 × 4 | 4 - 2 × 4 | 33% |
| | | 1 - 2 × 6 | | |
| 8.2 | 0 | 5 - 2 × 4 | 5 - 2 × 4 | 0% |
| 8.4 | 0 | 4 - 2 × 4 | 4 - 2 × 4 | 0% |
| | | 2 - 2 × 6 | 2 - 2 × 6 | |
| 9.0 | 0 | 5 - 2 × 4 | 5 - 2 × 4 | 0% |
| | | 2 - 2 × 6 | 2 - 2 × 6 | |
| 9.2 | 0.4 | 7 - 2 × 4 | 5 - 2 × 4 | 6.3% |
| | | 1 - 2 × 6 | 2 - 2 × 6 | |
| 9.7 | 0 | 9 - 2 × 4 | 9 - 2 × 4 | 0% |
| 9.9 | 0.9 | 7 - 2 × 4 | 9 - 2 × 4 | 11% |
| | | 2 - 2 × 6 | | |
| 10.2 | 1.1 | 6 - 2 × 4 | 9 - 2 × 4 | 17% |

TABLE I-continued

Comparison of Off-Center and Centered Logs Processed With ⅛ Inch Edger Kerf and 3/16 Inch Scragg Kerf

| Log Diameter | Lateral Offset | Yield With Offset | Yield Without Offset | Increased Yield |
|---|---|---|---|---|
| | | 3 - 2 × 6 | | |
| 10.6 | 0.6 | 8 - 2 × 4 | 9 - 2 × 4 | 22% |
| | | 2 - 2 × 6 | | |
| 10.7 | 0.5 | 9 - 2 × 4 | 10 - 2 × 4 | 20% |
| | | 2 - 2 × 6 | | |
| 11.0 | 0.9 | 11 - 2 × 4 | 10 - 2 × 4 | 25% |
| | | 1 - 2 × 6 | | |
| 11.6 | 0 | 8 - 2 × 4 | 8 - 2 × 4 | 0% |
| | | 4 - 2 × 6 | 4 - 2 × 6 | |
| 12.1 | 0.2 | 10 - 2 × 4 | 8 - 2 × 4 | 4% |
| | | 3 - 2 × 6 | 4 - 2 × 6 | |

The increase in lumber recovery attributable to offsetting is accomplished without sacrificing high production, as in the case of end dogging systems. The charger loads the lower spike chain from the side and travels downstream with the lower spike chain only a short distance. As a result, its recycle time is relatively short. Upon loading one log, the charger recycles simply by retracting radially the vertical carriage away from the spike chain, moving the horizontal carriage a short distance upstream to the carriage's start position, pivoting toward the cradle to pick-up the next log and then pivoting back toward the lower spike chain to load the log onto the spike chain. Even this short recycling period has not lost time for the most part because a certain delay is necessary to allow the preceding log to clear the loading area. Thus, the present invention is capable of processing the logs through the scragg saw essentially end to end, with the biggest limitation merely being the skill of the operator.

It will be appreciated that the step-wise movement of the log loading charger during loading and recycling can be eliminated to speed up its operation. For example, upon gripping a log from the cradle, the log loading charger's vertical carriages could be retracted radially as the entire charger is swung toward the lower spike chain to avoid the more time-consuming step-wise movement described earlier.

Having illustrated and described the principles involved in this invention by what is presently a preferred embodiment and some suggested alternatives, it should be apparent to those persons skilled in the art that such embodiments may be modified in arrangement and detail without departing from such principles. I claim as my invention all such modifications as come within the true spirit and scope of the invention as defined by the following claims.

I claim:

1. A lumber mill system used in processing logs into lumber comprising:

endless conveyor means movable along a conveyor path and having a logitudinal centerline;

log loading means for loading logs one at a time onto said endless conveyor means, each said log having a longitudinal centerline;

control means for detecting the diameter of each log to be processed, determining from the detected diameter how much, if at all, the centerline of each log should be offset laterally from the centerline of said endless conveyor means for optimum processing of the log downstream, and responsively controlling said log loading means to load the log onto said endless conveyor means with the lateral offset determined for such log;

log holding means to facilitate holding the log on said endless conveyor means, said log holding means being vertically movable between a retracted position and a holding position in which said holding means contacts an upper surface of the log;

a sawing or chipping apparatus downstream of said log loading means, said log holding means including a plurality of separate endless tooth carrying means upstream of said sawing apparatus for supporting the log's upper surface; and log infeed means for feeding logs one at a time to a log loading area proximate said log loading means, at least one of said tooth carrying means being located laterally adjacent said log loading area with the remaining tooth carrying means being located downstream thereof, and further including separate log sensing means cooperating with each said tooth carrying means for sensing the approach of a log on said endless conveyor means and responsively actuating said tooth carrying means to move downwardly from its retracted position to its holding position to permit said tooth carrying means to contact the log's upper surface as the log travels beneath said tooth carrying means.

2. A lumber mill system used in processing logs into lumber comprising:

endless conveyor means movable along a conveyor path and having a longitudinal centerline;

log loading means for loading logs one at a time onto said endless conveyor means, each said log having a longitudinal centerline;

control means for detecting the diameter of each log to be processed, determining from the detected diameter how much, if at all, the centerline of each log should be offset laterally from the centerline of said endless conveyor means for optimum processing of the log downstream, and responsively controlling said log loading means to load each log onto said endless conveyor means with the lateral offset determined for such log; and said log loading means including a frame, pivot means for pivoting said frame about a pivot axis parallel to the longitudinal axis of said endless conveyor means, and gripping means for gripping a circumferential portion of a log;

said log loading means including at least one radial carriage means supported by said frame for radial movement relative to the pivot axis, said gripping means being supported by said radial carriage means.

3. A lumber mill system according to claim 2 wherein said gripping means includes plural pairs of clamping members, each said clamping member pair being supported by a separate radial carriage means for radial movement toward and away from the pivot axis.

4. A lumber mill system according to claim 2 wherein said log loading means includes axial carriage means supported by said frame for horizontal movement parallel to the pivot axis, each said radial carriage means being supported by said axial carriage means.

5. A lumber mill system according to claim 3 wherein said log loading means includes axial carriage means supported by said frame and for horizontal movement parallel to the pivot axis, each said radial carriage means being supported by said axial carriage means.

6. A lumber mill system according to claim 4 wherein said control means includes actuating means for causing said log loading means to pivot about the pivot axis from a first position in which said gripping means is to the side of said endless conveyor means to a second position in which said gripping means is in the same vertical plane as said endless conveyor means, said actuating means having a rotatable arm operably connected to said pivot means.

7. A lumber mill system according to claim 6 wherein said control means further includes offsetting means cooperable with said actuating means for shifting the axis of rotation of said rotatable arm, thereby causing said gripping means to shift laterally relative to said endless conveyor means when said log loading means has been pivoted to the second position, whereby the centerline of a log gripped by said gripping means is also shifted laterally relative to the longitudinal centerline of the endless conveyor means.

8. A lumber mill system according to claim 7 wherein said actuating means is supported on a movable base, said offsetting means including an offset setworks fixed at one end and operably connected at the other end to said movable base.

9. A lumber mill system according to claim 8 wherein said control means includes encoding means cooperable with said gripping means for sensing the diameter of each log gripped by said gripping means, and microprocessing means programmed to determine from the log's diameter the amount of lateral offset, if any, necessary to optimize lumber recovery from the log, said control means controlling the offset setworks to obtain such lateral offset.

10. A lumber mill system used in processing logs into lumber comprising:

endless conveyor means movable along a conveyor path and having a longitudinal centerline;

log loading means for loading logs one at a time onto said endless conveyor means, each said log having a longitudinal centerline;

control means for detecting the diameter of each log to be processed, determining from the detected diameter how much, if at all, the qenterline of each log should by offset laterally from the centerline of said endless conveyor means for optimum processing of the log downstream, and responsively controlling said log loading means to load each log onto said endless conveyor means with the lateral offset determined for such log; and said log loading means including a frame, pivot means for pivoting said frame about a pivot axis parallel to the longitudinal axis of said endless conveyor means, axial carriage means supported by said frame and movable in the same direction as said endless conveyor means, at least one radial carriage means supported by said axial carriage means for movement toward and away from the pivot axis, and gripping means supported by each said radial carriage means.

11. A method of loading a log onto an endless, longitudinally extending conveyor means, the conveyor means moving in a downstream direction, the method comprising:

gripping a log such that its longitudinal axis is substantially parallel to the logitudinal axis of said conveyor means;

moving the log along a path toward the conveyor means while keeping the longitudinal axis of the log substantially parallel to the longitudinal axis of said conveyor means, the path intersecting a vertical plane extending upwardly from said conveyor means;

stopping the movement of the log when it is positioned above said conveyor means;

lowering the log onto said conveyor means while simultaneously moving the log in the same direction and at the same speed as said conveyor means, without changing the lateral position of the conveyor means; and releasing the grip on the log once it is stably supported by said underlying conveyor means.

12. The method of claim 11 further comprising:

before lowering the log onto said coveyor means, determining how much, if any, the longitudinal axis of the log should be laterally offset relative to the longitudinal axis of the conveyor means and then stopping the movement of the log at a position such that when the log is lowered onto the conveyor means its longitudinal axis is laterally offset from the longitudinal axis of the conveyor means by the determined amount.

13. A method of automatically loading logs one at a time onto an endless, longitudinally extending conveyor means, with the longitudinal axis of each log having a preselected lateral orientation relative to the longitudinal axis of said conveyor means, the method comprising the step:

gripping a horizontal log such that its longitudinal axis is parallel to the longitudinal axis of said conveyor means;

determining the diameter of the log;

determining from such diameter the optimum lateral offset, if any, of such log on said conveyor means for further processing;

pivoting the log along an arcuate path toward the conveyor means while keeping the longitudinal axis of the log parallel to the longitudinal axis of said conveyor means, the arcuate path intersecting a vertical plane extending upwardly from said conveyor means;

terminating the pivoting movement of the log once the log is positioned above said endless conveyor means with its longitudinal axis at the predetermined lateral offset relative to the longitudinal axis of said conveyor means;

lowering the log onto said conveyor means; and releasing the grip on the log.

14. The method of claim 13 comprising circulating said endless conveyor means such that its upper log supporting surface moves downstream, and moving the log downstream with the upper log supporting surface while simultaneously lowering the log onto such surface.

15. The method of claim 14 wherein the log is moved downstream at the same speed as the supporting surface.

16. In a lumber mill system having a log sawing or other processing station and a substantially longitudinally aligned endless conveyor means upstream thereof for feeding logs to the processing station, an overhead holddown apparatus to facilitate holding a log on the endless conveyor means, comprising:

endless tooth carrying means carrying an endless row of spaced teeth, said endless tooth carrying means being supported above said endless conveyor means upstream of the processing station;

supporting means for supporting said endless tooth carrying means for vertical movement relative to said endless conveyor means, said supporting means permitting said endless tooth carrying means to travel vertically between a retracted position and a holding position in which at least one of said teeth supportively penetrates and moves with an upper surface of an underlying log being conveyed on said endless conveyor means; and said endless tooth carrying means having a longitudinal axis substantially parallel to and in substantially the same vertical plane as the longitudinal axis of said endless conveyor means, said supporting means including plural support arms pivotally interconnected to said tooth carrying means, said support arms restricting the movement of said tooth carrying means such that the longitudinal axis of said tooth carrying means remains substantially parallel to and in substantially the same vertical plane as the longitudinal axis of said endless conveyor means when said tooth carrying means is moved vertically toward said endless conveying means, whereby said teeth essentially contact only the most elevated portion of the underlying log.

17. In a lumber mill system having a log sawing or other processing station and a substantially longitudinally aligned endless conveyor means upstream thereof for feeding logs to the processing station, an overhead holddown apparatus to facilitate holding a log on the endless conveyor means, comprising:

endless tooth carrying means carrying an endless row of spaced teeth, said endless tooth carrying means being supported above said endless conveyor means upstream of the processing station;

supporting means for supporting said endless tooth carrying means for vertical movement relative to said endless conveyor means, said supporting means permitting said endless tooth carrying means to travel vertically between a retracted position and a holding position in which at least one of said teeth supportively penetrates and moves with an upper surface of an underlying log being conveyed on said endless conveyor means;

a frame; and plural support arms supported by said frame and pivotally interconnected to said tooth carrying means, said frame, tooth carrying means and support arms forming a three dimensional parallelogram linkage, whereby those teeth protruding toward an underlying log form a row that is always substantially parallel to the underlying conveying means and hence typically penetrate only the most elevated portion of the log's underlying upper surface.

18. The apparatus of claim 17 wherein each said support arm is pivotally connected to said frame at one end by pins and to said tooth carrying means at the other end, said support means further including cylinder powered linkage means for causing said support arms to pivot about said pins, whereby the pivoting movement of said support arms causes said tooth carrying means to move vertically.

19. The apparatus of claim 17 wherein said linkage means includes plural links which together with said support arms and tooth carrying means also forms a three dimensional parallelogram linkage.

20. An apparatus for loading logs one at a time onto an endless conveyor means comprising:

a frame;

pivot means for pivoting said frame about a pivot axis parallel to a longitudinal centerline of said conveyor means;

axial carriage means supported by said frame for horizontal movement in the same direction as said conveyor means;

at least one radial carriage means supported by said axial carriage means for movement toward and away from the pivot axis;

gripping means supported by each said radial carriage means for gripping a circumferential portion of a log; and actuating means for causing said frame to pivot about the pivot axis from a first position in which said gripping means is to the side of said conveyor means to a second position in which the gripping means is above said conveyor means.

21. An apparatus according to claim 20 wherein said actuating means includes a rotatable arm having an axis of rotation and linkage means operably interconnecting said frame and rotatable arm, whereby rotation of said rotatable arms causes said frame to pivot about the pivot axis.

22. An apparatus according to claim 21 further including offsetting means cooperable with said actuating means for shifting the axis of rotation of said rotatable arm laterally relative to said conveyor means, whereby the position of the gripping means relative to the conveyor means is also shifted laterally.

* * * * *

UNITED STATES PATENT AND TRADEMARK OFFICE

CERTIFICATE OF CORRECTION

PATENT NO. : 4,628,781

DATED : December 16, 1986

INVENTOR(S) : DANIEL S. ROWLEY

It is certified that error appears in the above-identified patent and that said Letters Patent is hereby corrected as shown below:

In the Specification

Column 5, line 4, "process" should be --processed--.

In the Claims

Claim 1, column 15, line 58, "logitudinal" should be --longitudinal--.

Claim 10, column 17, line 43, "qenterline" should be --centerline--.

Claim 11, column 17, line 65, "logitudinal" should be --longitudinal--.

Claim 14, column 18, line 50, after "13" insert --further--.

Signed and Sealed this

Thirty-first Day of March, 1987

*Attest:*

*Attesting Officer*

DONALD J. QUIGG

*Commissioner of Patents and Trademarks*